United States Patent [19]

Gibb

[11] Patent Number: 4,860,306

[45] Date of Patent: Aug. 22, 1989

[54] HOT ZONE EMPLOYING GRAPHITE HEATING ELEMENTS

[75] Inventor: Thomson B. Gibb, Southampton, Pa.

[73] Assignee: Vacuum Furnace Systems Corporation, Souderton, Pa.

[21] Appl. No.: 253,499

[22] Filed: Oct. 5, 1988

[51] Int. Cl.[4] ..... H05B 3/08

[52] U.S. Cl. ..... 373/112

[58] Field of Search ..... 439/87, 883, 804, 807; 373/111, 112, 110, 114, 125, 128, 132, 133

[56] References Cited

U.S. PATENT DOCUMENTS 4,259,538 3/1981 Jones ..... 373/112

4,425,660 1/1984 Jones ..... 373/112

4,429,403 1/1984 Hooper ..... 373/111

*Primary Examiner*—Roy N. Envall, Jr.

*Attorney, Agent, or Firm*—William E. Cleaver

[57] ABSTRACT

The present arrangement includes a plurality of graphite support assemblies which serve to hold graphite heating elements of a graphite hot zone to be used with a vacuum furnace. Each of the support assemblies is designed to employ graphite bolts. Laminated graphite washers are located between the bolts and the graphite heating elements and between the graphite heating elements and the support assemblies so that the bolts do not loosen in response to cycles of hot and cold temperatures.

2 Claims, 4 Drawing Sheets

HOT ZONE EMPLOYING GRAPHITE HEATING ELEMENTS

BACKGROUND OF THE DISCLOSURE

In the design of vacuum furnace systems commonplace to employ a hot zone structure, which is made up of a plurality of heating elements strips, fabricated from molybdenum which is commonly called moly and will be called moly throughout this description. In one prior art design of a moly hot zone, each moly heating strip is formed into an incomplete circle and those circular elements are stacked beside one another to form a cylinder-like structure. In another design of a moly hot zone, each heating ring is formed of a plurality of heating strips. Together the moly heating strips make a chain of heating elements which when viewed together form an open ended ring-like structure with a gap between the starting heating strip and the ending heating strip. The one piece moly ring and the ring of the moly elements, are incomplete because, at one of the two open ends, electrical energy must be applied and at the other of the two open ends, the electrical energy completes the circuit excursion and passes on to another open ring or to an electrical terminal. While the foregoing moly hot zones have been quite acceptable, there are occasions when it is preferable to use a graphite hot zone. For instance, in a brazing operation the filler material, or the brazing material often drips toward the bottom of the furnace and lands on the moly heating elements and does damage to those moly heating elements. If the vacuum furnace is equipped with a graphite hot zone, there is virtually no damage from the dripping filler material because the graphite is rugged and does not either mechanically or chemically respond damagewise to dripping hot filler material. Accordingly, in the event of such prospective use, the furnace user often wants to employ a graphite hot zone design. It has been the practice heretofore to design a graphite hot zone by having a plurality of graphite heating strips formed in an open ended circular chain-like fashion. The ends of each of the strips are held by support members which are secured to some secure structure in the furnace. In the prior art, the end of the graphite heating strip chain (that is connected to the electrical energy terminal) is held by a graphite support member which was fashioned to go to the top of the furnace chamber. Near the top of the furnace chamber the graphite support member makes a direct connection to the copper input leads which come from the electrical energy source. Such an arrangement in the past gave rise to difficulty when the user wanted to convert the furnace from a graphite hot zone into a moly heating ring mode of operation. By having the graphite support member, in the prior art, fashioned to pass through the insulating section surrounding the hot zone, the conversion is made quite difficult. The present arrangement permits the terminal support assembly to be readily clamped to a moly terminal rod and readily removed therefrom if the user decides to convert the furnace from a graphite hot zone into a moly hot zone arrangement. In addition, the present system includes graphfoil (laminated graphite) washers located between the graphite bolts and the graphite heating elements as well as between the graphite heating elements and the support ears, or protrusions, of the support member so that the resiliency of the graphfoil permits the expanding graphite to expand while at the same time does not permit the graphite bolt to work its way into a "loose" condition.

SUMMARY OF THE DISCLOSURE

The present arrangement is directed to employing graphite members instead of molybdenum members as hot zone structure. Graphite material is rugged and not bendable so in order to construct a circular type hot zone, the ring must be made up of a plurality of straight graphite heating elements in the form of a polygon. In a preferred embodiment the graphite heating elements for a vacuum furnace are each 10 1/16" long except for the first heating element and some twelve such graphite heating elements are employed. The first heating element of the ringlike chain, of the foregoing preferred embodiment, which is connected to the electrical terminal, is 9" long. The graphite heating elements are not overlapped but are held in pairs along the ring-like path by graphite support members. The graphite support assembly members are made up of three types. The first type is the electrical terminal support assembly, the second is the ring periphery support assembly and the third type is the bridge support assembly. The electrical terminal support member, in the present arrangement, is very different from the prior art terminal support member. In the prior art the terminal support member was formed and disposed to pass through the heat insulating ring, which normally surrounds the hot zone. The terminal support member is extended to a position which is very close to the outside wall of the furnace chamber. At that position the terminal support member is connected to the copper leads from the electrical power source. The present power terminal support assembly comprises a block which has a channel cut therein. The channel measurement is the width of the moly power rod which is normally connected to the copper leads. However, the channel is slightly less in measurement along its depth dimension than is the moly power rod. In addition to the block there is a keeper member which bridges the width of the channel. When the keeper member is secured to the block, the assembly of the keeper and the block is secured to the moly rod by friction. In the present arrangement there is a laminated graphite washer located between the block and the keeper on each side of the channel and the depth of the washer is equal to the difference between the depth of the moly rod and the depth of the channel. It should also be understood that there is a first and a second threaded aperture formed in the block and a first and a second aperture formed in the keeper. Accordingly, when the keeper is properly located, with respect to the block and the molybdenum rod, then the first aperture in the keeper is axially in alignment with the first threaded aperture in the block while the second aperture in the keeper is axially aligned with the second threaded aperture in the block. In addition, there are two molybdenum spacers and two graphite bolts involved. The first graphite bolt along with the first molybdenum spacer (which has an aperture therein) are lined up on one side of the block so that the bolt can be passed through the aperture in the molybdenum spacer, through the first aperture in the keeper, and threaded into the first threaded aperture in the block. The second graphite bolt along with the second molybdenum spacer (which has aperture therein) are aligned up opposite the second aperture in the keeper and the second threaded aperture in the block. When the second bolt is passed through the aperture in the second molybdenum spacer and through the second aperture in the keeper, it can be threaded into the second threaded aperture in the block and thus the keeper is "tightened up" against the molybdenum rod which is located in the channel. It should be noted that there is a graphfoil washer (laminated graphite) located between the first molybdenum spacer and the keeper. Note also that there is also a second graphfoil washer located between second molybdenum spacer and the keeper. Thus, when the spacer and the keeper and the graphite bolts are assembled as described above, the graphfoil washers provide resilience to the assembly to compensate for expansion and contraction of the materials. In this particular assembly, when the terminal support moly terminal rod gets warm or hot, it expands. At the same time, the moly spacers expand. Accordingly the molybdenum power terminal would tend to expand and try to push the keeper away from the block while the two molybdenum spacers would expand and tend to push the keeper toward the block as well as toward the molybdenum rod. In this way the expansion efforts are counterbalancing and the assembly stays in a fixed position, firmly secured to the molybdenum power rod and without causing the graphite bolts to loosen up.

The second type support assembly (identified as ring periphery support members) including a block member which has first and second wing-like protrusions extending therefrom. The block member of the second type support assembly has an aperture therethrough and through that aperture there is located a support rod assembly. In each of the wing-like protrusions, there is formed a threaded aperture and on each of those wing-like protrusions there is located in abutment the end of an associated graphite heating element. Each of the heating elements has an aperture therein so that a graphite bolt can be passed therethrough and threaded into the threaded aperture of the associated wing-like protrusions. Accordingly, each of the graphite ring periphery support members supports a pair or at least the ends of a pair of graphite heating elements. It should be noted that between the head of the graphite bolt and the upper end of the heating element there is located a graphfoil (laminated graphite) washer and between the lower side of the heating element and the wing protrusion there is located a second graphfoil washer. The graphfoil washers just mentioned serve as described before to provide resiliency (as well as a good electrical connection) between the various graphite members so that whatever expansion may take place (even though graphite has a relatively low coefficient of expansion) that expansion can be compensated for by the graphfoil washers. This arrangement serves to keep the graphite bolts in place without loosening up.

The objectives and features of the present invention will be better understood in view of the following description taken in conjunction with the drawings wherein.

Figure 1:
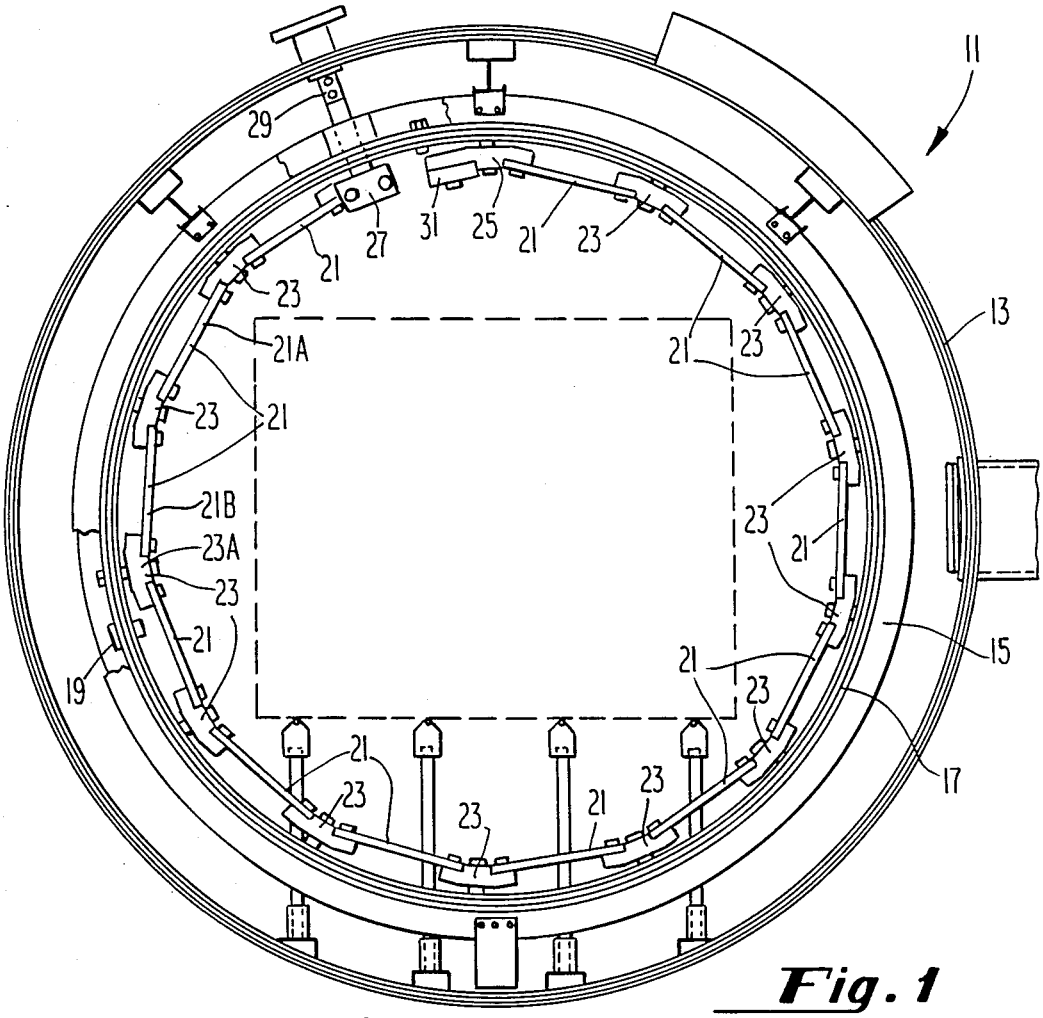
FIG. 1 is a pictorial schematic of a graphite hot zone located a vacuum furnace.

Consider FIG. 1. In FIG. 1 there is shown a vacuum furnace 11. The vacuum furnace 11 is composed of an outside chamber 13, a plenum 15, a heat insulating enclosure 17 and a plurality of plenum outlet nozzles only one of which is shown at 19. Inside of the vacuum furnace, as just described, there is located a hot zone. The hot zone is made up of the graphite heating elements 21 as well as the graphite periphery ring support members 23. In addition to the graphite periphery ring support members 23, there are two special support members, namely the bridging support member 25 and the power terminal support member 27. The graphite heating elements, of course, heat up when electrical energy is passed therethrough. The electrical energies applied from the copper terminal 29, through the terminal support member 27 along each of the heating elements 21, through the associated periphery ring support assemblies 23, back to the bridging terminal 25. Bridging terminal 25 has a bridge member 31 connected thereto which provides a circuit path over to a similar ring which lies (with respect to the FIG. 1) in back of the ring just described. In other words, the current coming in from terminal 29 at some point in time would be going counter clockwise around the heating elements 21 and the periphery ring support assemblies 23, through the bridge member 31 to a second ring of heating elements and support members and clockwise through those last mentioned heating elements and support members back to a terminal similar to the terminal 29 to complete the circuit.

Figure 2:
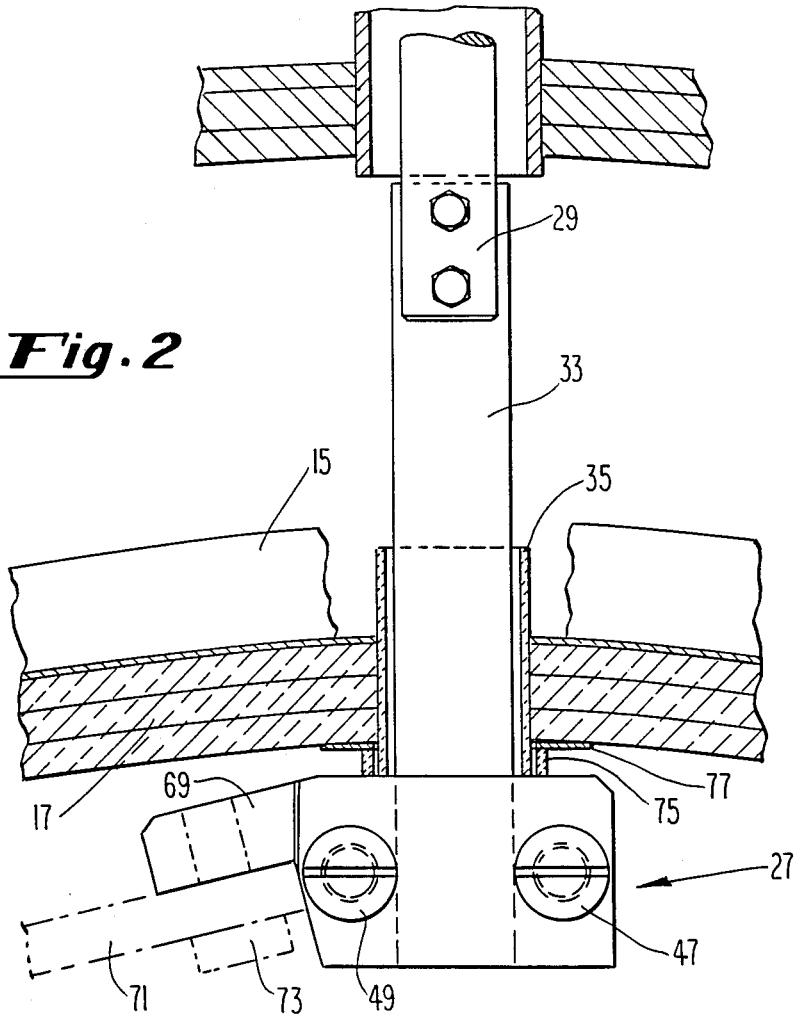
FIG. 2 is a front view of a power terminal support assembly.

Let us consider the power support assembly 27 which is shown in greater detail in FIG. 2. In FIG. 2 there is shown the copper electrical terminal 29 which is bolted to the moly terminal rod 33. The moly terminal rod 33 is located inside of the ceramic sleeve 35 and both the ceramic sleeve 35 and the moly terminal rod 33 pass through the plenum 15 and through the heat insulation package 17. If we examine FIG. 3 which is a bottom view of the power terminal support assembly, we see that the moly power rod 33 fits into the channel 37. The channel 37 is cut, or formed, into the block 39. It will be noted that the depth dimension 41 of the channel 37 is not as long as the depth dimension 43 of the moly power rod 33. Accordingly when the keeper 45 is pulled up against the block 39 in response to the graphite bolts 47 and 49 being threaded into the threaded apertures 51 and 53, there is a friction contact between the keeper 45 and the moly power rod 33. As can be detected or determined in FIG. 3, there is a washer 55 located between the block 39 and the keeper 45 on the right hand side as viewed in FIG. 3 and there is a washer 57 located between the block 39 and the keeper 45 on the left hand side of FIG. 3. The washers 55 and 57 are laminated graphite commercially known as graphfoil. The laminated graphite has a certain resiliency so that when the bolts 47 and 49 push the keeper 45 toward the block 39, there is a good electrical contact between the keeper 45 and the block 39 through the washers and the washers provide some resiliency or flexibility with respect to expansion (particularly expansion of the moly power rod 33 and the moly spacers 59 and 61) due to heat.

Figure 3:
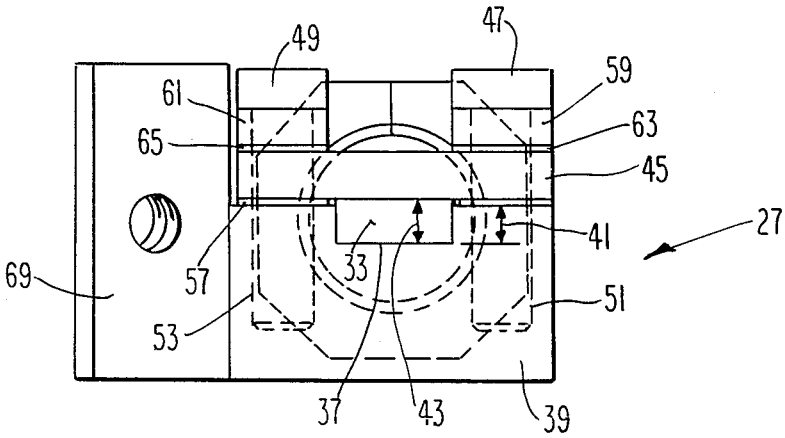
FIG. 3 is a top view of the assembly shown in FIG. 2.

As also can be determined by examining FIG. 3, there is a molybdenum spacer 59 located between the graphite bolt 47 and the keeper 45 on the right hand side of the figure. On the left hand side of the figure it can be gleaned that there is a molybdenum spacer 61 located between the graphite bolt 49 and the keeper 45. In between the molybdenum spacer 59 and the keeper 45 on the right hand side, there is located a graphfoil washer 63 while on the left hand side of FIG. 3 it can be determined that there is a graphfoil washer 65 located between the molybdenum spacer 61 and the graphite keeper 45. The washers 63 and 65 also provide resiliency to accommodate for the expansion of the molybdenum spacers 59 and 61 when the structure is heated. By having the molybdenum spacers 59 and 61 located as shown in FIG. 3, we have determined that if the power terminal becomes heated up, as it does in fact become, the molybdenum rod 33 tends to push the keeper 45, in response to its expansion, away from the block 39. On the other hand the molybdenum spacers 59 and 61 tend to push the keeper toward the block 39 and hence there is a set off of the expansion forces and the power terminal assembly remains firmly locked onto the molybdenum power rod 33. We have found empirically that if the washers 55, 63, 65 and 57 are not employed, and the power terminal assembly 27 goes through cyclical expansions and contractions, the bolts 47 and 49 tend to "loosen up". On the other hand, we have found that if the structure is arranged as shown in FIG. 3 and the power terminal assembly 27 is subjected to cycles of hot and cold, the bolts 47 and 49 do not loosen up.

Note in FIG. 3 that there is an ear-like protrusion 69 extending from the block 39 and it is to that protrusion 69 that the first of the heating elements is secured. This can be better seen in FIG. 2. In FIG. 2 there is shown a heating element 71 which is secured to the ear-like protrusion 69 by the graphite bolt 73. Further, in FIG. 2 it can be noted that there is a ceramic sleeve 75 which surrounds the ceramic sleeve 35 and the ceramic sleeve 75 is capped by a washer 77. The sleeve 75 and washer 77 prevent material, which is floating within the vacuum furnace, from building up between the wall of the ceramic sleeve 35, the insulation package 17 and the terminal support member 27.

Figure 4:
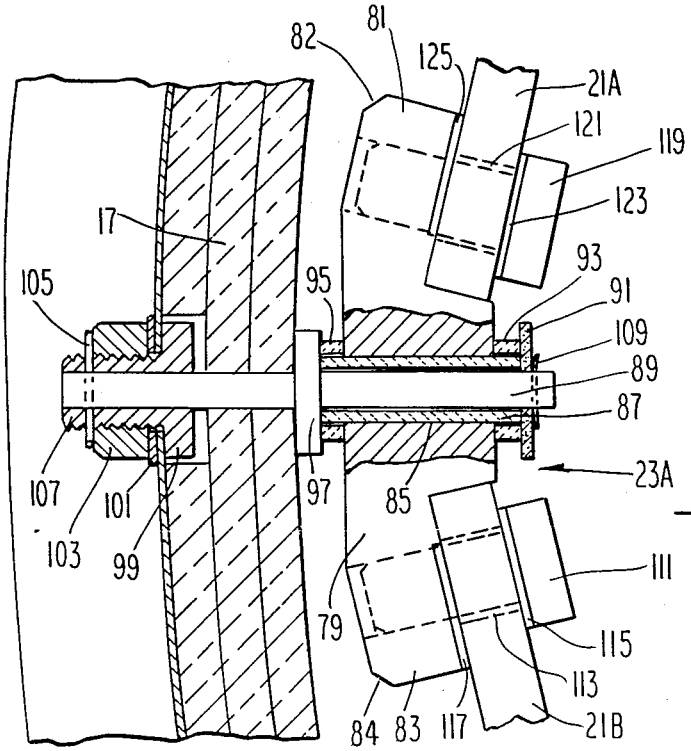
FIG. 4 is a side view of a ring support assembly.

If we look at FIG. 1 again, and in particular look at the periphery support member 23A we find that it is supporting the graphite heating elements 21A and 21B. Let us look at FIG. 4 which depicts in detail the periphery support member 23A. The periphery support member 23A is made up of a center block 79 from whence there is formed two earlike protrusions 81 and 83. In the center of the block 79, there is formed an aperture 85. Located through the aperture is a ceramic sleeve 87 and within that ceramic sleeve 87 there is located a stud 89. It can be gleaned from FIG. 4 that located between the center block 79 and a graphite washer 91, there is located a spacer 93. On the back end of the block 79 is located a second spacer 95 which is located between the block 79 and a bar 97. The bar 97 is made of graphite and has a plurality of apertures therein. The stud 89 passes through an associated aperture in the bar 97, through the insulating package 17, and through a bolt 99. Bolt 99 is threaded externally and as can be seen in FIG. 4, a washer 101 and a take up nut 103 are secured onto the bolt 99 to provide the support for the stud 89 and therefore the physical support for the periphery support member 23A. Located through the stud 89 is a cotter pin 105 and threaded up against the cotter pin there is a second takeup nut 107. At the front end of the stud 89 there is located a second cotter pin 109.

As can be seen in FIG. 4, the ear-like protrusions 81 and 83 provide a basis for supporting the two graphite heating elements 21B and 21A which we discussed in connection with FIG. 1. Note in FIG. 4 that the graphite heating element 21B is secured against the ear-like protrusion 83 by virtue of the graphite bolt 111. Graphite bolt 111 passes through an aperture 113 in the heating element 21B and is threaded into the ear-like protrusion 83. Located between the graphite bolt 111 and the heating element 21B is a laminated graphite washer 115. Also located between the graphite heating element 21B and the ear-like protrusion 83 is a laminated graphite washer 117. The structure on the other protrusion side of the block 79 is virtually identical as that just described, with a graphite bolt 119 passing through an aperture 121 to be threaded into the ear-like structure 81. Located between the graphite bolt 119 and the heating elements 21A is a laminated graphite washer 123 while a second laminated graphite washer 125 is located between the heating element 21A and the ear-like protrusion 81. The laminated graphite washers 115, 117, 121 and 125 provide resilience and good electrical connections to accommodate the take up procedure when the heating elements 21A and 21B are fastened to the terminal assembly 23A. We have found empirically that if the washers 115, 117, 123 and 125 are not employed, then the bolts 119 and 111 tend to loosen with repeated cycles of hot and cold. Note also in FIG. 4 that the ear-like protrusions 81 and 83 are bevelled at the inside corner as depicted by the bevels 82 and 84. We have found that if the corners are so bevelled it eliminates the arcing phenomenon between the block and the insulation package 17.

The foregoing described graphite hot zone arrangement enables the system to be readily changed from a graphite system to a molybdenum system and vice versa. By virtue of having the power terminal assembly readily clamped onto the molybdenum power rod, as described above, enables the whole assembly to be disassembled without the difficulty experienced in the prior art. By having the periphery support graphite assemblies readily removable from the support studs such as support stud 89 in FIG. 4, the remainder of the hot zone can be readily disassembled because the heating elements simply come apart by removing the graphite bolts and that removable feature includes removing the bridging support device 25.

I claim:

1. A section of a graphite hot zone in a vacuum furnace comprising in combination: graphite block means having first aperture means formed therethrough, said graphite block means having first and second protrusions extending therefrom, said first protrusion formed to have a first locking aperture therein, said second protrusion formed to have a second locking aperture formed therein; stud assembly means formed and disposed to fit through said first aperture to be secured to an inner part of said vacuum furnace; first graphite heating element means having a first securing aperture formed therein with said first graphite heating element means disposed to have its first securing aperture in substantial axial alignment with said first locking aperture; second graphite heating element means having a second securing aperture formed therethrough with said second graphite heating element means disposed to have said second securing aperture located in substantial axial alignment with said second locking aperture; first graphite bolt means disposed through said first securing aperture and into said first locking aperture to secure said first graphite heating element to said first protrusion means; second graphite bolt means disposed through said second securing aperture into said second locking aperture to secure said second graphite heating element means to said second protrusion means; first and second washer means formed of laminated graphite with said first washer means disposed between said first graphite bolt means and said first heating element and with said second washer means disposed between said first heating element and said first protrusion; third and fourth washer means formed of laminated graphite with said third washer means disposed between said second bolt means and said second heating element and with said fourth washer means disposed between said second heating element and said second protrusion means.

2. A section of a graphite hot zone according to claim 1 wherein said first and second securing apertures are threaded apertures respectively in said first and second protrusions.

* * * * *